US012571230B2

(12) United States Patent
Ko

(10) Patent No.: US 12,571,230 B2
(45) Date of Patent: Mar. 10, 2026

(54) VEHICLE ROOFTOP TENT

(71) Applicant: Hyun Il Ko, Suwon (KR)

(72) Inventor: Hyun Il Ko, Suwon (KR)

( * ) Notice: Subject to any disclaimer, the term of this patent is extended or adjusted under 35 U.S.C. 154(b) by 134 days.

(21) Appl. No.: 18/449,399

(22) Filed: Aug. 14, 2023

(65) Prior Publication Data

US 2023/0383565 A1 Nov. 30, 2023

Related U.S. Application Data

(63) Continuation of application No. PCT/KR2021/011797, filed on Sep. 1, 2021.

(30) Foreign Application Priority Data

Feb. 22, 2021 (KR) ..... 10-2021-0023704

(51) Int. Cl.
*E04H 15/06* (2006.01)
*E04H 15/48* (2006.01)
*E04H 15/56* (2006.01)

(52) U.S. Cl.
CPC ..... *E04H 15/06* (2013.01); *E04H 15/48* (2013.01); *E04H 15/56* (2013.01)

(58) Field of Classification Search
CPC ..... E04H 15/06; E04H 15/008
See application file for complete search history.

(56) References Cited

U.S. PATENT DOCUMENTS 2,710,977 A * 6/1955 Fannin ..... B60P 3/38 135/96
2,811,725 A * 11/1957 Cence ..... B60P 3/38 135/117
3,351,078 A * 11/1967 Kleiman ..... B60P 3/38 135/153
3,506,299 A * 4/1970 Arnold ..... B60P 3/341 296/170

(Continued)

FOREIGN PATENT DOCUMENTS

CN 208564146 U 3/2019
JP H07-002012 A 1/1995

(Continued)

OTHER PUBLICATIONS

International Search Report issued in PCT/KR2021/011797; mailed Nov. 10, 2021.

*Primary Examiner* — Noah Chandler Hawk
(74) *Attorney, Agent, or Firm* — IPLA P.A.

(57) ABSTRACT

The present disclosure provides a vehicle rooftop tent including a tent, an upper case, a link structure, a lower case, and an extension plate. The tent has an upper end connected to the upper case and a lower end connected to a lower case and the extension plate. The upper case includes a hard-shell cover and a straight section fastened by an extrusion structure rivet. The link structure is disposed at each corner of the lower case. The extension plate is unfolded and folded in conjunction with the opening and closing of the tent. The lower case has a honeycomb structure. The extension plate (Continued)

is unfolded and extended to both sides of the lower case to expand a floor area when the tent is open, and is folded to be stored in an upper portion of the lower case to reduce the floor area when the tent is closed.

10 Claims, 14 Drawing Sheets

(56) References Cited

U.S. PATENT DOCUMENTS

| | | | | |
|---|---|---|---|---|
| 3,575,460 | A * | 4/1971 | Kennedy | B60P 3/38 5/8 |
| 4,366,979 | A * | 1/1983 | Pillot | B60P 3/38 296/160 |
| 2015/0292230 | A1* | 10/2015 | Park | B60P 3/39 135/88.13 |
| 2019/0352924 | A1* | 11/2019 | Currid | B60P 3/38 |
| 2021/0025190 | A1* | 1/2021 | Montesalvo | E04H 15/54 |
| 2021/0270055 | A1* | 9/2021 | Park | E04H 15/48 |

FOREIGN PATENT DOCUMENTS

| | | | |
|---|---|---|---|
| KR | 10-0555135 | B1 | 2/2006 |
| KR | 10-1318392 | B1 | 10/2013 |
| KR | 10-1420589 | B1 | 7/2014 |
| KR | 10-1516916 | B1 | 5/2015 |
| KR | 10-2015-0142480 | A | 12/2015 |
| KR | 10-1748407 | B1 | 6/2017 |
| KR | 10-1771155 | B1 | 8/2017 |

* cited by examiner

VEHICLE ROOFTOP TENT

CROSS-REFERENCE TO RELATED APPLICATIONS

The present application is a Continuation of International Patent Application No. PCT/KR2021/011797, filed on Sep. 1, 2021, which is based upon and claims the benefit of priority to Korean Patent Application No. 10-2021-0023704 filed on Feb. 22, 2021. The disclosures of the above-listed applications are hereby incorporated by reference herein in their entirety.

TECHNICAL FIELD

The present disclosure relates to a vehicle rooftop tent, in particular, to a vehicle rooftop tent in which convenience of installation, ease of expansion, and excellence in tent quality are realized with a simple configuration.

BACKGROUND ART

Recently, as interest in camping using vehicles has increased, demand for so-called rooftop tents, which are tents installed on the roofs of cars, is increasing. The rooftop tent refers to a tent installed on the roof of a car, that is, a roof. This rooftop tent can be moved and installed in a state of being mounted on the roof of a car, does not require a separate parking space, and is inexpensive, so the rooftop tent is widely used in recent years.

Since the rooftop tent is used by having the bottom surface fixed on the roof of a car and extending upward, the rooftop tent can be easily installed and removed without being restricted by obstacles or places compared to a tent installed on the ground.

The rooftop tent includes a lower case that is fixed to a roof rack of a car and forms the bottom of the tent and an upper case that forms a resting area as the upper case is deployed to the top along with a cloth covering a side surface during installation, and it is common for the rooftop tent to be moved in a state of being mounted on a vehicle and to form the tent by deploying the upper case upwards and covering the surroundings with the covering cloth at a camping site.

As an example of the prior art related to the rooftop tent (FIG. 1), an "automatic open/close rooftop tent" (Korean Patent No. 10-1318392, registration date: Oct. 8, 2013) is known, and this technology relates to an "automatic open/close rooftop tent", and specifically, relates to "an automatic rooftop tent which includes a fixed plate fixed to the roof of the vehicle and a bottom plate configured of a rotating plate overlapped with the fixed plate by a driving device and in which the tent is installed on the upper surface of the bottom plate to automatically install or disassemble the tent according to the rotation of the rotating plate so as to install and disassemble the tent". However, this technology only provides the automatic opening/closing rooftop tent technology, and when the rotating plate is unfolded, not only is there a stability problem with the tent because the tent is not located in the center of the vehicle, but also there is a problem of inconvenience in the installation, disassembly, and use of the tent because the driving device is crude.

As another example of the prior art related to the rooftop tent (FIG. 2), a "space expansion type hard shell rooftop tent for vehicles" (Korean Patent No. 10-1420589, registration date: Jul. 10, 2014) is known, and this technology relates to "a vehicle rooftop tent in which a support pole is lifted by the tent cloth along with drawing out of an extension plate from a lower case mounted on a vehicle roof". Specifically, the prior art relates to "a vehicle rooftop tent including a lower case that is detachably fixed to the roof of the vehicle and an upper case that closes or opens the lower case by an opening/closing unit, the vehicle rooftop tent including: an extension plate that is slidably connected to the lower case; support poles having both ends pivotably connected to both sides of the rear end of the expansion plate; and a tent cloth connected to at least the upper case, the support pole, and the expansion plate, in which the expansion plate can slide between a first position overlapping the lower case and a second position maximally drawn out from the lower case, the support pole is located adjacent to the extension plate when the extension plate is located at the first position, and is lifted upward by the tent cloth when the extension plate is located at the second position. However, this technology only provides vehicle rooftop tent technology, and when the extension plate slidably connected to the lower case is unfolded, not only is there a stability problem with the tent because the tent is not located in the center of the vehicle, but also there is a problem of inconvenience in the installation, disassembly, and use of the tent because the driving device is crude.

As still another example of the prior art related to the rooftop tent (FIG. 3), a "vehicle rooftop tent" (Korean Patent No. 10-1516916, registration date: Apr. 24, 2015) is known, and this technology is also known as a "vehicle rooftop tent". The prior art relates to "a vehicle rooftop tent including an extended tent, an annex, and a top tent, in which a variable connection portion is provided in the cover portion that serves as waterproofing by covering an upper portion of the top tent and connections portion of the top tent and the extended tent, and the variable connection portion can stably shield the rooftop tent and the connection portion while being actively deformed according to the shape of the extended tent. Specifically, the prior art relates to "a vehicle rooftop tent including a top tent installed on the roof of the vehicle, an auxiliary tent provided under the top tent, an extension tent connected to a side surface of the auxiliary tent, and a cover portion provided above top of the top tent, in which the cover portion further includes a variable connection portion on a surface corresponding to the position where the extended tent is connected, and the variable connection part has two opening/closing portions, one each in the vertical direction, on both sides of the edge, and an inner skin having a wider width toward the bottom is provided inside the opening/closing portion has a wider width toward the bottom". However, the technology relates to the installation of the auxiliary tent and the extended tent, and as the vehicle rooftop tent, the structure is complicated and there are problems of inconvenience in installation and disassembly.

As still another example of the prior art related to the rooftop tent (FIG. 4), a "foldable and expandable rooftop tent" (Korean Patent No. 10-1748407, registration date: Jun. 12, 2017) is known, and this technology relates to a "foldable and expandable rooftop tent that includes a tent body installed on a roof of a vehicle and an extension body extending from the tent body. Specifically, the prior art relates to "a foldable and expandable rooftop tent in which a tent body includes a lower cover that is formed of a hard material and has a first driving unit and a second driving unit facing each other on the inside, an upper cover that is formed of a hard material, located to correspond to the upper side of the lower cover, and has a first guide bar and a second guide bar corresponding to the first driving unit and the second driving unit, and a first elevating unit and a second elevating unit that connects the first driving unit of the lower cover and the first guide bar of the upper cover and connects the second driving unit of the lower cover and the second guide bar of the upper cover so that the upper cover can move up and down with respect to the lower cover, and the extension body includes a second hinge body hinge-coupled to a first hinge body of the lower cover, an extension plate inserted and folded between the lower cover and the upper cover by the hinge rotation of the first hinge body and the second hinge body and overlapped or unfolded from between the lower cover and the upper cover, a support frame provided at an end of the extension plate, and a folding ladder in which an upper end is connected to a lower surface of the extension plate". However, this technology only provides the vehicle rooftop tent technology, and when the folding expansion plate is unfolded, not only is there a stability problem with the tent because the tent is not located in the center of the vehicle, but also there is an inconvenient problem in installation, disassembly, and use of the tent because the driving device is crude.

As still another example of the prior art related to the rooftop tent (FIG. 5), a "rooftop tent opening/closing device" (Korean Patent No. 10-1771155, registration date: Aug. 18, 2017) is known. This technology relates to "a rooftop tent opening/closing device in a rooftop tent equipped with a case opened or closed upward and downward so that the rooftop tent is installed on the roof of a vehicle to allow the user to easily sleep or rest during travel, the upper case is opened by the expansion action of the damper to unfold the tent, and it can be folded after use, in which the upper case is opened by an expansion operation of a damper to unfold the tent, when folded after use, a wire connected to the upper case is wound around a shaft installed in the lower case to close the lower case while contracting the damper that supports the upper case to be open, frames having a plurality of reinforcing bars exhibiting durability and reinforcing power are installed facing each other inside the lower case fixedly installed on a roof rack of the vehicle and the upper case coupled to be opened and closed, a link bent and extended by a pressure of the damper is provided between the frames, a shaft rotated by a driving unit is installed on the outside of the lower reinforcing bar to forcibly bend the link to wind the wire that closes the upper case in the open state, and a pawl operated by operation of the lever exposed to the outside of the lower case is installed to prevent reverse rotation while a ratchet wheel is joined to the shaft and rotational force of the driving unit is applied". However, the technology only provides the technology to open or close the upper case of the rooftop tent up and down, not only is it unable to provide technology to expand the lower case, but the rooftop opening/closing device is complicated and crude, making it inconvenient to install and disassemble the rooftop tent.

This disclosure is made to solve the above-mentioned problems of the prior arts.

DISCLOSURE OF THE INVENTION

Technical Problem

Therefore, the present disclosure is further improved to solve the problems of the prior art as described above, and a first task of the present disclosure is to provide a vehicle rooftop tent in which a rooftop tent can be unfolded with one touch to provide enough space for the whole family to enjoy camping together, and the whole family can safely enjoy camping together.

A second task of the present disclosure is to provide a vehicle rooftop tent in which the rooftop tent can be easily installed with a one-touch operation and can be closed with a one-touch when closing the rooftop tent to fold the rooftop tent after use.

A third task of the present disclosure is to provide a vehicle rooftop tent with high stability in setting of the tent by maintaining the open state of the tent after installing the vehicle rooftop tent.

A fourth task of the present disclosure is to provide a vehicle rooftop tent with high durability even after multiple uses in the vehicle rooftop tent.

A fifth task of the present disclosure is to provide a vehicle rooftop tent in which strength is improved, a lightweight structure is achieved, and deformation is minimized in the vehicle rooftop tent.

A sixth task of the present disclosure is to provide a vehicle rooftop tent capable of preventing condensation inside the tent caused by a temperature difference between the inside and outside of the tent.

Various problems to be solved by the present disclosure are not limited to the problems mentioned above, and other problems not mentioned will be clearly understood by those skilled in the art from the description below.

Technical Solution

According to one embodiment of the present disclosure, there is provided a vehicle rooftop tent (1000) including: a tent (1200); an upper case (1300); a link structure (1400); a lower case (1500); and an extension plate (1510), in which the tent (1200) has an upper end connected to a periphery of the upper case (1300) and a lower end connected to a periphery of a lower case (1500) and a periphery of the extension plate (1510) so that opening and closing are performed with one touch, the upper case (1300) includes a hard-shell cover to minimize deformation, improve strength, and implement a lightweight structure, and includes a corner portion and a straight section fastened by an extrusion structure rivet (1320), the link structure (1400) is disposed at each corner of the lower case (1500) so that the tent (1200) is opened and closed with one touch, and is configured so that the extension plate (1510) is automatically unfolded and folded in conjunction with the opening and closing of the tent (1200), the lower case (1500) has a honeycomb structure to improve strength and implement a lightweight structure, and the extension plate (1510) is configured to be automatically unfolded and extended to both sides of the lower case (1500) to expand a floor area when the tent (1200) is open, and is configured to be automatically folded to be stored in an upper portion of the lower case (1500) to reduce the floor area when the tent (1200) is closed.

According to another embodiment of the present disclosure, each link structure (1400) may include a link (1410), a shock absorber (1420), and a hinge (1430) configured to open and close the tent (1200) with one touch, an upper connector (1485) and a lower connector (1495) configured to automatically unfold and fold the extension plate (1510) in conjunction with the opening and closing of the tent (1200) with one touch, and a connector spring (1480) for pulling the extension plate (1510) into the lower case (1500) when the extension plate (1510) is folded.

According to still another embodiment of the present disclosure, each link structure (1400) may further include a connector fixing pin (1490) that fixes the upper connector (1485) and the lower connector (1495) so that the opening state of the tent (1200) is maintained and stability in setting of the tent is secured.

According to still another embodiment of the present disclosure, each link structure (1400) may further include at least one pair of high-strength wires (1900) configured to support the extension plates (1510) connected to both sides of the lower case (1500) in a state where the tent (1200) is open.

According to still another embodiment of the present disclosure, the vehicle rooftop tent (1000) may further include a pole (1520), in which both ends of the pole (1520) may be connected to the link structure (1400) and stored in the upper end of the lower case 1500 when the tent 1200 is closed, and when the tent (1200) is opened, the pole 1520 may maintain a predetermined angle with the extension plate (1510) while being unfolded in conjunction with the extension plate (1510) to expand an indoor space of the tent (1200) and maintain tension of the tent (1200).

According to still another embodiment of the present disclosure, the vehicle rooftop tent (1000) may further include a closing webbing strap (1800) for uniformly pulling the upper case (1300) downward so that the rooftop tent (1000) is closed by a one-touch operation when the rooftop tent (1000) is closed after use.

According to still another embodiment of the present disclosure, the hinge (1430) may further include a hinge fixing device (1440) for fixing the upper case (1300) so that the upper case (1330) does not move when the tent (1200) is opened, and even when the link (1410) is accidentally pushed by the hinge fixing device (1440) or the upper case (1300) is pressed, the opening state of the tent (1200) may be maintained so that stability in setting of the tent is secured.

According to still another embodiment of the present disclosure, the upper case (1300) may further include a spherical joint (1450) having a shaft hole at a portion connecting the link (1410), and the spherical joint (1450) may be a double joint or a one-sided bolt joint having three axial degrees of freedom, and the spherical joint (1450) may increase the degree of freedom of the hinge (1430) to prevent deformation of the link (1410) caused by twisting of the link (1410) when the upper case (1300) is sequentially opened or closed back and forth.

According to still another embodiment of the present disclosure, the lower case (1500) may have a double layer structure including a predetermined heat insulating layer (1540) on an upper portion of the lower case (1500) to prevent condensation inside the tent (1200) caused by a temperature difference between the inside and outside of the tent (1200).

According to still another embodiment of the present disclosure, the link structure (1400) may further include a predetermined groove (1470) configured to fix a lower end of the tent (1200) so that the lower end of the tent (1200) is fixed to the lower case (1500) even in a case where a tent pole is broken when the tent (1200) is installed.

According to still another embodiment of the present disclosure, the rooftop tent (1000) may further include a solar cell (1600) on a side surface of the lower case (1500) to generate power required when using the tent (1200).

According to still another embodiment of the present disclosure, the vehicle rooftop tent may further include a ladder (1560) configured to support the extension plate (1510) in a state where the rooftop tent (1000) is open, in which the ladder (1560) may have an extendable leg at a lower end portion thereof and a detachable fabric so that a pet climbs to the inside of the rooftop tent.

Effects of the Invention

The present disclosure has the following very good advantages.

1. Each extension plate is configured on both sides of the lower case, the link structure is provided in which the extension plate is stored to be superimposed on the lower case when the rooftop tent is closed, and when the rooftop tent is opened to use, both extension plates that are overlapped and stored in the lower case are automatically unfolded along with the tent, the extension plate is supported by at least one pair of high-strength steel wires centered on the link structure, and thus, the rooftop tent can be unfolded with one touch, providing enough space for a family of four to enjoy together, and the whole family can safely enjoy together.
2. By introducing the compressed gas shock absorber to expand the upper case (hard shell cover) upward, the rooftop tent can be easily installed with a one-touch operation when opening (installing) to use the rooftop tent, and when closing (folding) the rooftop tent after use, the rooftop tent can be closed with one touch using the closing webbing strap.
3. By introducing a rod-shaped hinge fixing device that fixes the hinges of both links so that the upper case is fixed without moving when the rooftop tent is spread upwards and opened (when set), or by introducing a fixed pin that fixes and connects the upper connector and lower connector connecting the extension plate to the lower case in a state where the rooftop tent is open, even when the link is accidentally pushed or the upper case is pressed after installing the tent, the open state of the tent remains unchanged, so the stability in the setting of the tent is high.
4. By applying (applying the double joint or applying the one-sided bolt joint capable of 3 degrees of freedom) the spherical joint equipped with the shaft hole to the portion connecting the upper case and the link, the degree of freedom of the hinge is increased, and when opening or closing the upper case of the rooftop tent sequentially back and forth, deformation of the links caused by twisting of the links is prevented, so the durability of the rooftop tent is high.
5. By adopting the hard-shell cover structure for the strength improvement and lightweight structure of the upper case and introducing an aluminum extrusion structure rivet to fasten the corner portion and the straight section, it is possible to minimize the deformation of the upper case.
6. By introducing a "U"-shaped telescopic pole having a spring-loaded push pin that unfolds in conjunction with the extension plate connected to the lower case, when the rooftop tent is opened, the interior space of the tent is expanded and the tension of the tent can be maintained.
7. By introducing the closing webbing strap to close the tent with one touch when the rooftop tent is not in use, it is possible to open and close the rooftop tent with one touch.
8. By applying a honeycomb structure to the lower case, the strength of the lower case is improved and a lightweight structure is achieved, and by adding the heat insulating layer to the top of the lower case and applying a double layer structure, it is possible to prevent condensation inside the tent caused by the temperature difference between the inside and outside of the tent.

9. By introducing a predetermined groove for fixing the lower end of the tent to a part of the link structure of the lower case, in a case where the tent is installed in the rooftop tent having the lower case equipped with the extension plate, the lower end of the tent can be fixed to the lower case even when the tent stick is broken.
10. The ladder for entering the tent is configured so that a separate fabric is easily attached and detached to the ladder, and thus, even pets, not people, can climb into the tent.
11. By installing the solar cell on the side surface of the bottom plate of the lower case, it is possible to supply the necessary power within the tent while using the tent (1200).

It will be sufficiently understood that the embodiments of the present disclosure may provide various effects not specifically mentioned.

DESCRIPTION OF EXEMPLARY EMBODIMENTS

Figure 1:
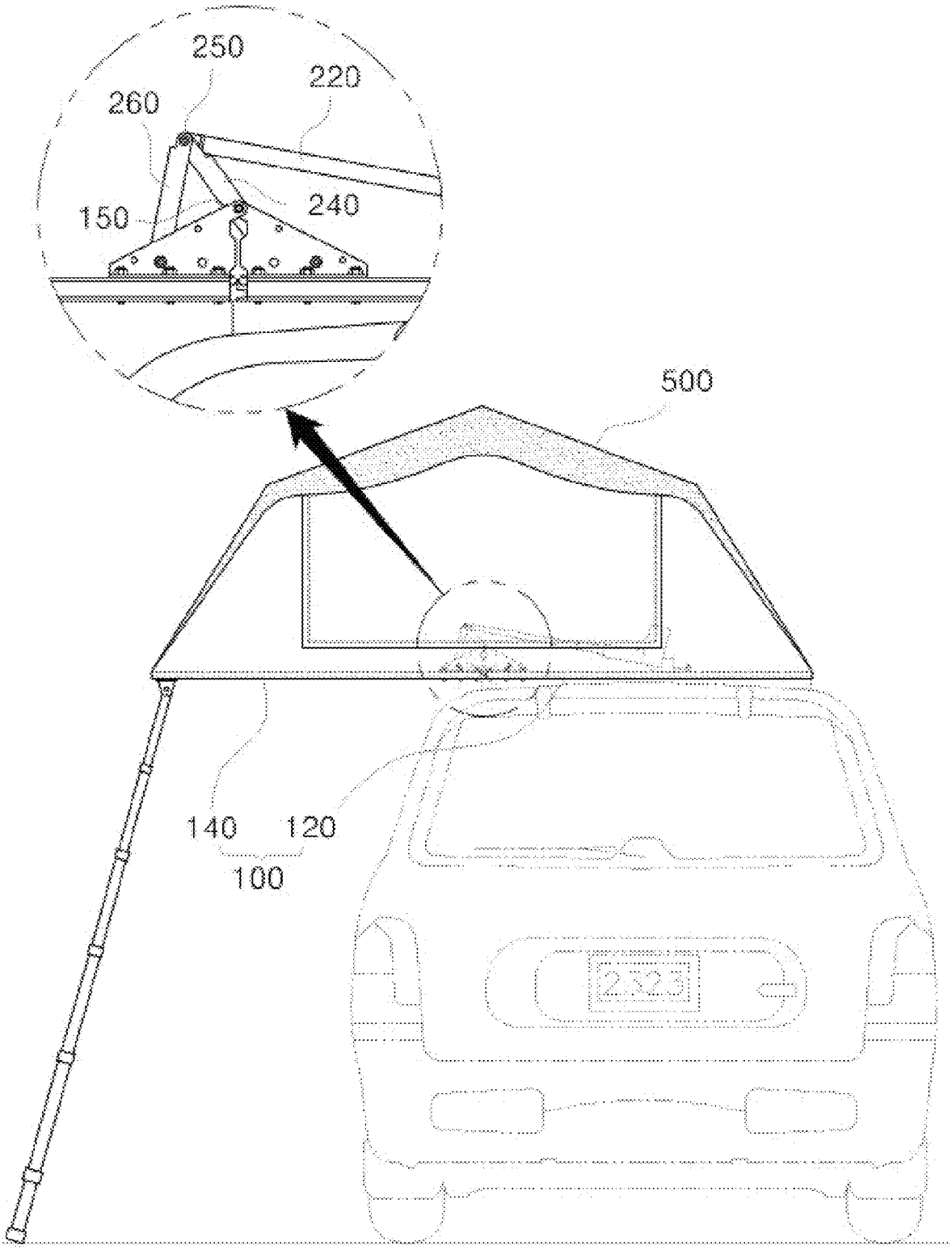
FIGS. 1, 2, 3, 4, and 5 illustrate embodiments of rooftop tents of the related art.
Figure 2:
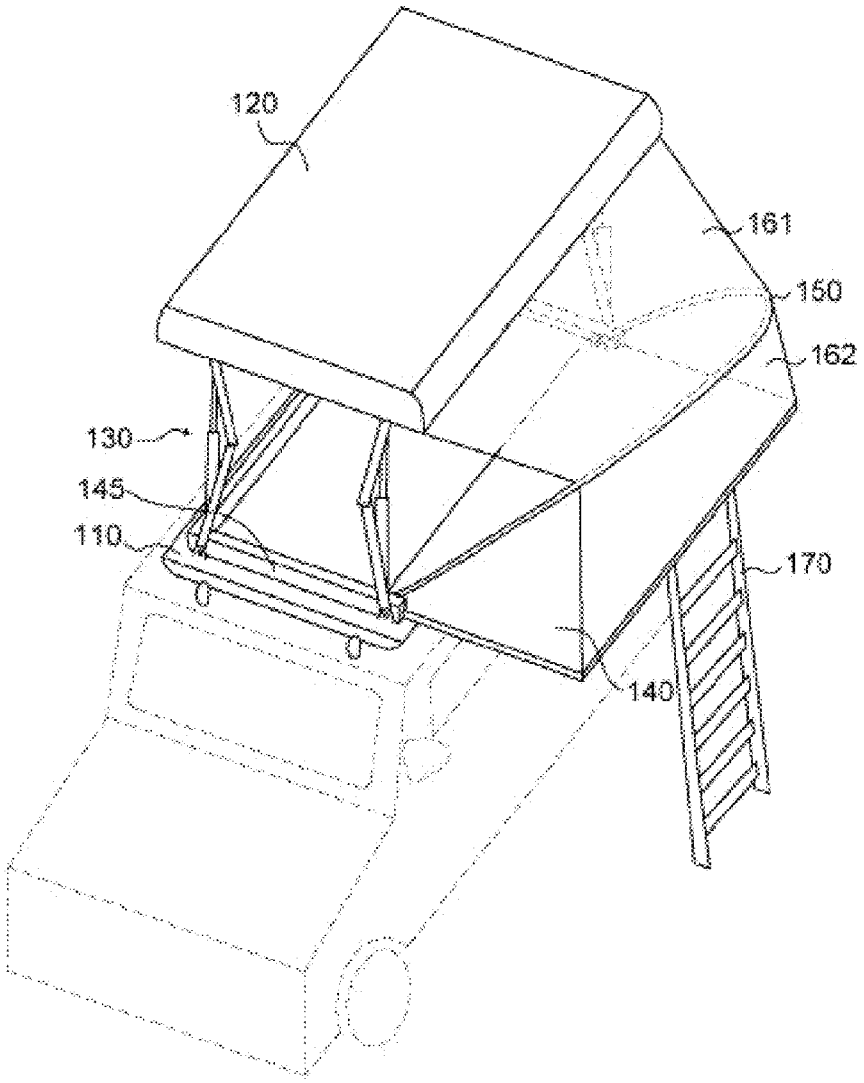
Figure 3:
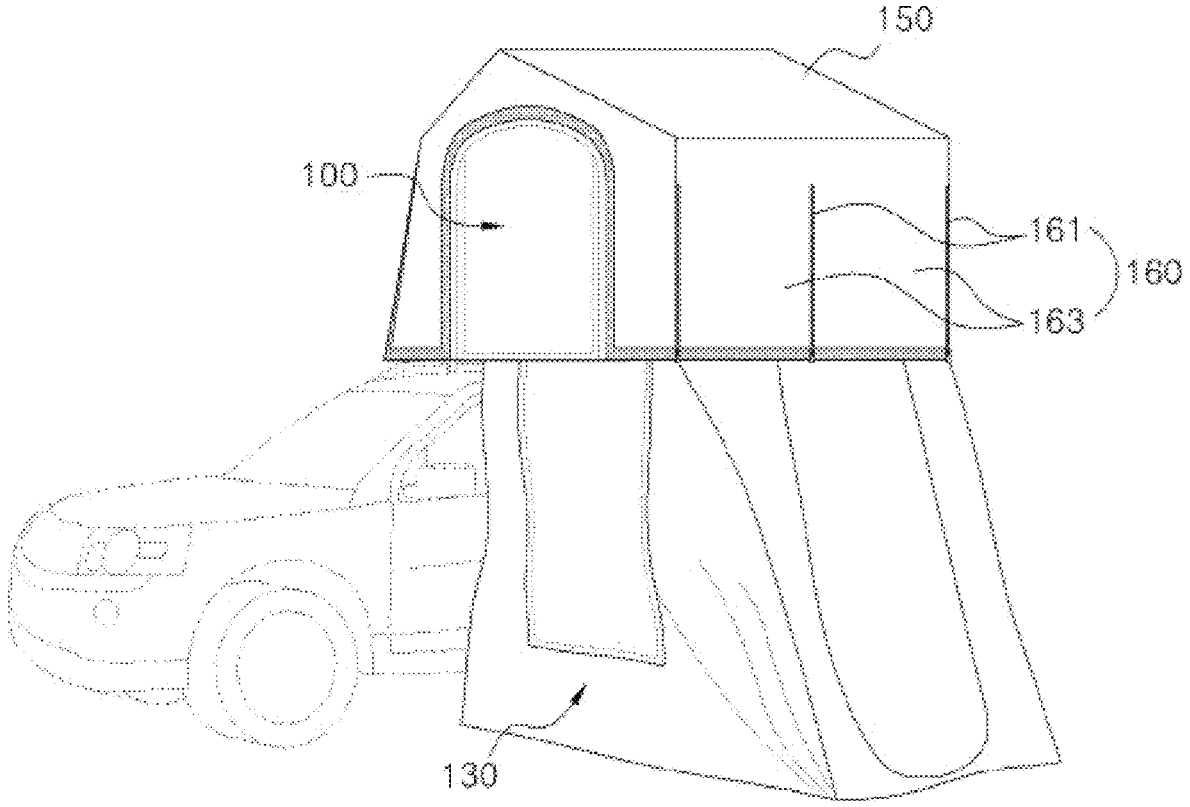
Figure 4:
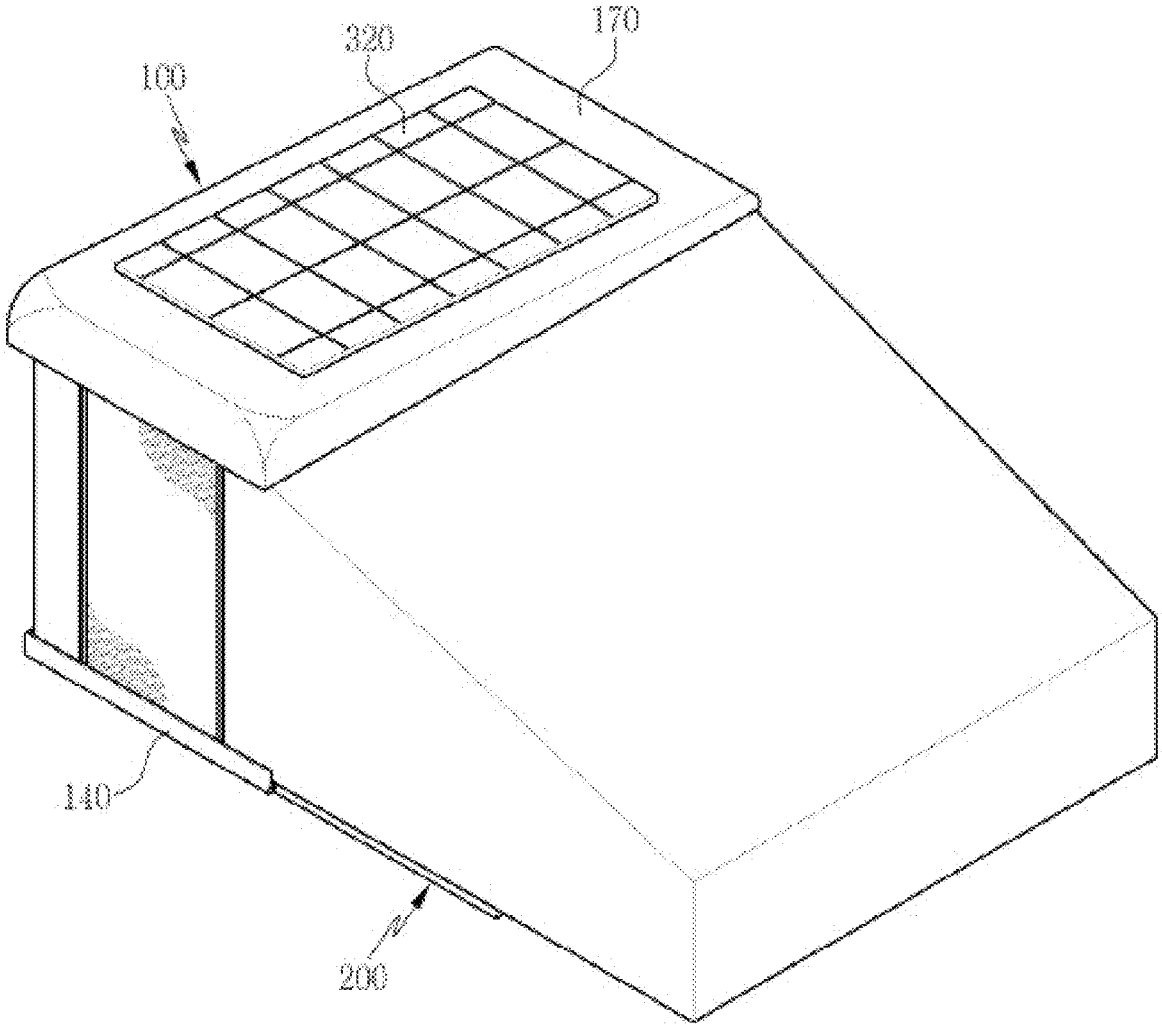
Figure 5:
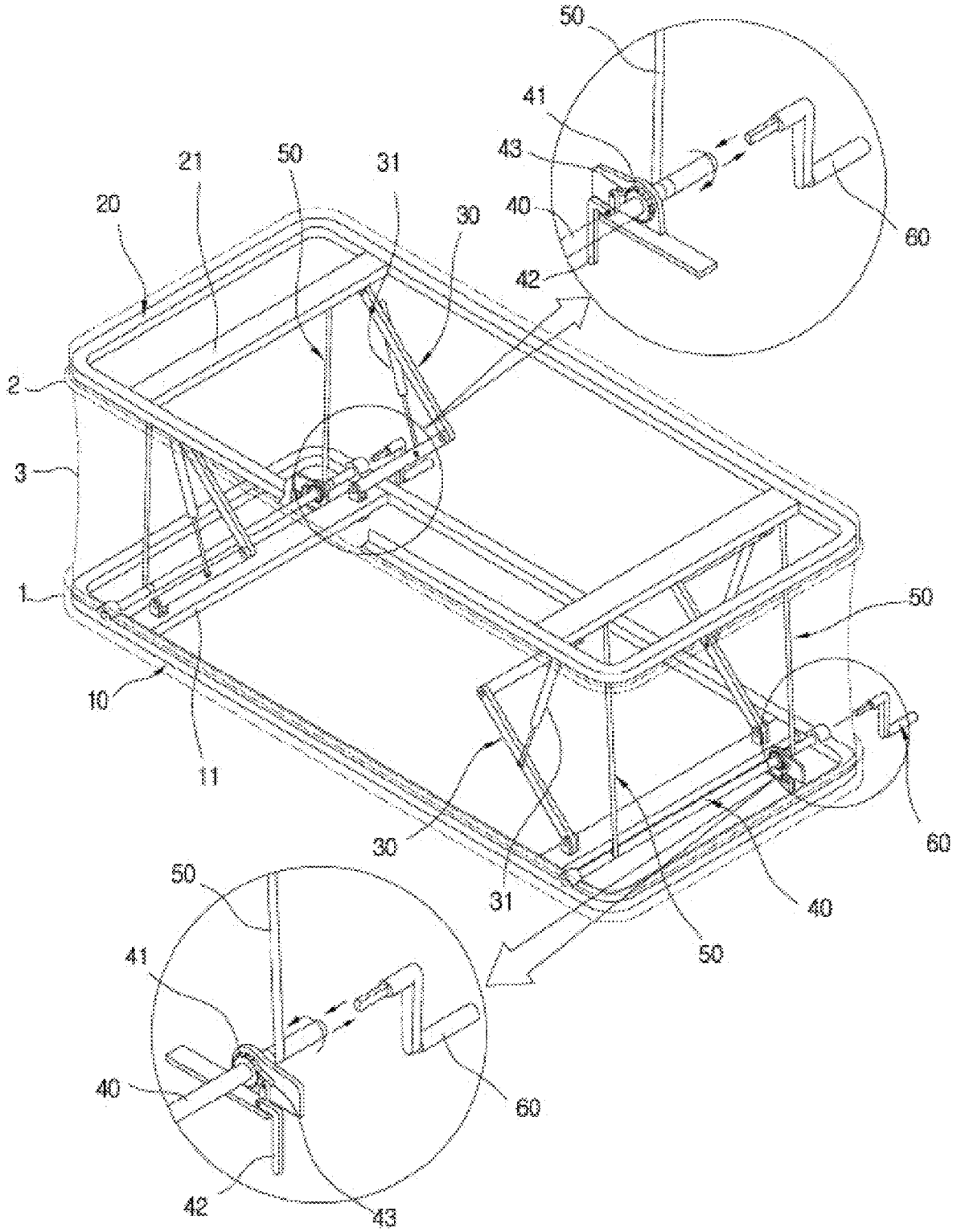

Embodiments of the present disclosure may be modified in various forms, and in each drawing, the same members are marked with the same reference numerals, and it should be noted that detailed descriptions of known functions and configurations that may unnecessarily obscure the subject matter of the present disclosure are omitted.

A rooftop tent 1000 of the present disclosure is a vehicle rooftop tent 1000 equipped with a function of automatically unfolding both extension plates 1510 connected to a lower case 1500 at the same time as an upper case 1300 is opened. The rooftop tent 1000 can be easily installed and closed after use by men and women of all ages with a one-touch operation and can be installed in most vehicles, and a direction of the tent entrance can also be selected according to a vehicle, and there is little sense of heterogeneity in design.

In addition, by applying premium materials and ergonomic design, the rooftop tent of the present disclosure is a completed rooftop tent that compensates for the disadvantages of the rooftop tent of the prior art, and provides sufficient and spacious space expansion for the whole family to enjoy together and a rich sense of openness with windows on all sides.

In addition, the rooftop tent 1000 of the present disclosure can be said to be a completed rooftop tent that solves all problems such as condensation, height, and mattress generated in the rooftop tent of the prior art. Since the extension plate 1510 connected to both sides of the lower case is opened with one touch in conjunction with the opening of the rooftop tent 1000, in one embodiment, the rooftop tent of the present disclosure provides enough space for a family of four to enjoy together, making it easy and safe for the whole family to enjoy together.

In addition, the rooftop tent 1000 of the present disclosure can set an entrance direction of the rooftop tent 1000 according to a direction of a seat of a driver of the vehicle and solves parking problems such as entering the parking lot with a low height. Moreover, the rooftop tent 1000 of the present disclosure has an aerodynamic design, which can minimize the reduction in fuel efficiency and noise generation of the vehicle when moving while mounted on the roof of the vehicle, and by minimizing the width of the product in the closed state of the rooftop tent, the rooftop tent of the present disclosure has a design that fits well with a variety of vehicles from small cars to large cars, and also has excellent expandability.

In addition, the problem of condensation in the rooftop tent, which was not solved in the prior art, is fundamentally solved by applying a thermally stable composite panel with improved temperature resistance stability through thermal flow simulation, thereby preventing the chronic condensation on the bottom of the rooftop tent in the prior art.

In addition, the exterior design is configured in a streamlined form like a clam shell to give a sense of psychological stability, thereby minimizing wind resistance and securing high user stability even in strong winds such as typhoons.

In addition, in one embodiment, the upper case 1300 adopts a high-strength metal frame and a renewable material (ABS), thereby enabling a structurally stable and eco-friendly consumption cycle product (100% recovery/regeneration cycling system). In one embodiment, the tent 1200 provides a pleasant and comfortable user environment as if breathing in nature by maximizing breathability by applying high-density canvas fabric.

In addition, in one embodiment, a fly material of the tent 1200 blocks UV even in areas with a high UV index to block hazards in safety of a user and maximizes waterproof performance to complement the highly breathable canvas skin.

In addition, in one embodiment of the present disclosure, the pole 1520 has high resistance even in bad weather and ensure safety of the user by adopting a high-stiffness material such as a Duralumin Pole of A70xx series (Duralumin) applied to an aircraft wing.

In addition, a one-action opening function is implemented in the rooftop tent of the present disclosure, so that the rooftop tent can be popped up with one action, which has the advantage of providing considerable convenience to users. In addition, in one embodiment, in the rooftop tent 1000 of the present disclosure, high-strength 100% renewable aluminum that is not deformed even under a uniform load of 1.4 ton is adopted, a shock absorber 1420 that can support a force of up to 70 Kgf is applied, and thus, it is possible to install the tent naturally when installing the tent. Moreover, in one embodiment, by providing an access passage for pets as a separate accessory, the harmony between nature, humans, and animals is maximized.

One embodiment of the present disclosure will be described in more detail as follows.

Figure 6:
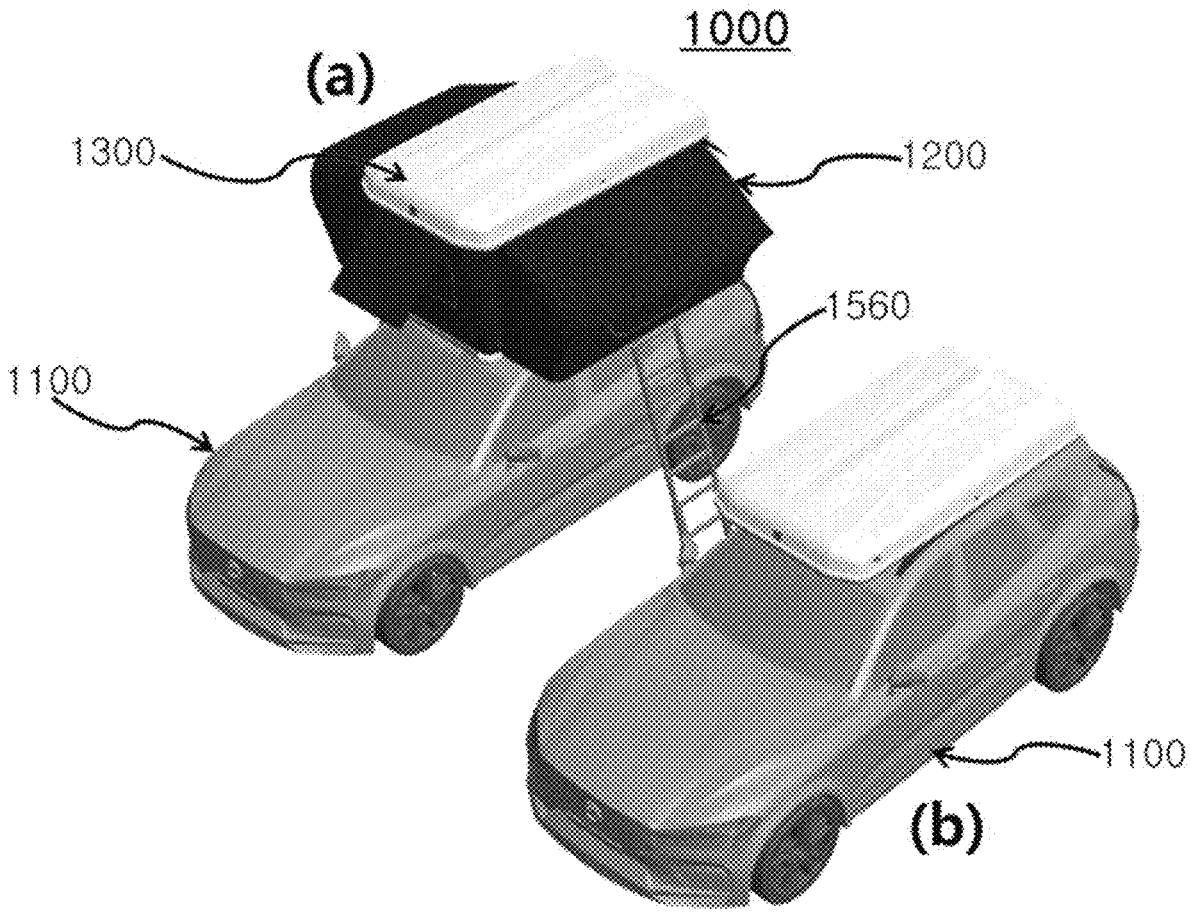
FIG. 6 illustrates a state where a rooftop tent 1000 of the present disclosure is mounted on a vehicle in an open (installed) state, and a state where the rooftop tent 1000 of the present disclosure is mounted on the vehicle in a closed (folded) state.

(a) of FIG. 6 illustrates a state where a rooftop tent 1000 of the present disclosure is mounted on a vehicle in an open (installed) state, and (b) of FIG. 6 illustrates a state where the rooftop tent 1000 of the present disclosure is mounted on the vehicle in a closed (folded) state. When the upper case 1300 is pushed upward, the rooftop tent 1000 is unfolded while a link 1410 and the shock absorber 1420 expand. Moreover, by a link structure 1400 located at the corner of the lower case 1500, the extension plate 1510 and pole 1520 are naturally unfolded in conjunction with the opening operation of the rooftop tent 1000, so that the open state of the rooftop tent 1000 is implemented. In a state where the rooftop tent 1000 is open, a hinge fixing device 1440 is fixed to a hinge 1430 located at the center of the link 1410, the pole 1520 is attached to the extension plate 1510 with a webbing strap 1530, and thus, the open state of the rooftop tent 1000 is implemented. Of course, at this time, a ladder 1560 at the entrance and a support 1570 on the opposite side support the extension plate 1510 so that the user can safely use the rooftop tent 1000.

Figure 7:
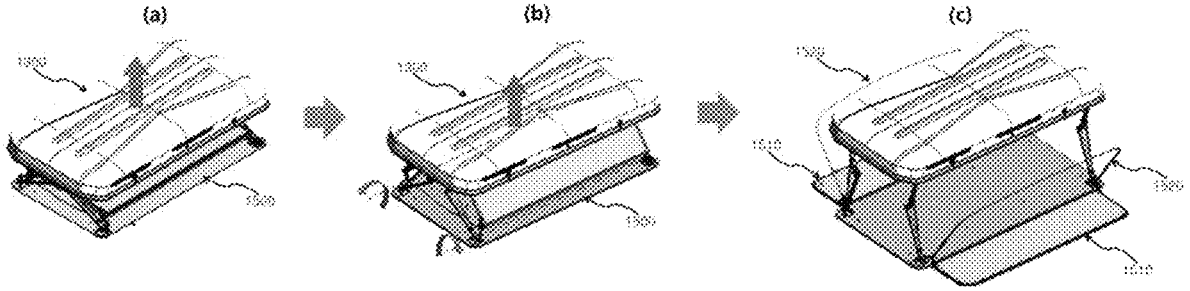
FIG. 7 illustrate each step of the opening operation to use the rooftop tent 1000 of the present disclosure, and illustrate a process in which an extension plate 1510 and pole 1520 are automatically unfolded in conjunction with each step of the opening operation.

(a), (b), and (c) of FIG. 7 illustrate each step of the opening operation to use the rooftop tent 1000 according to one embodiment of the present disclosure, and illustrate a process in which the extension plate 1510 and the pole 1520 are automatically unfolded in conjunction with each step of the opening operation. In (a) of FIG. 7, when the upper case 1300 is pushed upward, the link 1410 and the shock absorber 1420 start to expand upward with the link structure 1400 as a central axis. (b) of FIG. 7 illustrates a state where the extension plate 1510 and the pole 1520 folded on top of the lower case 1500 are unfolded in conjunction with the opening operation of the upper case 1300 by the link structure 1400 when the upper case 1300 moves upward. (c) of FIG. 7 illustrates a state where the extension plate 1510 and the pole 1520 are completely unfolded in a state in which the upper case 1300 is fully opened. The extension plate 1510 and pole 1520 are stored together on the upper portion of the lower case 1500 in a state where the rooftop tent 1000 is closed, and the extension plate 1510 is unfolded in a straight line with the lower case 1500 but the pole 1520 is not fully unfolded and unfolding of the pole 1520 stops at a position at which a predetermined angle (approximately 45 degrees) with the extension plate 1510 is maintained in a state where the rooftop tent 1000 is fully open. The pole 1520 stops at this position because of tension of the tent 1200 applied to the pole 1520. In this state, the pole 1520 is fixed to the end portion of the extension plate 1510 by the webbing strap 1530.

Figure 8:
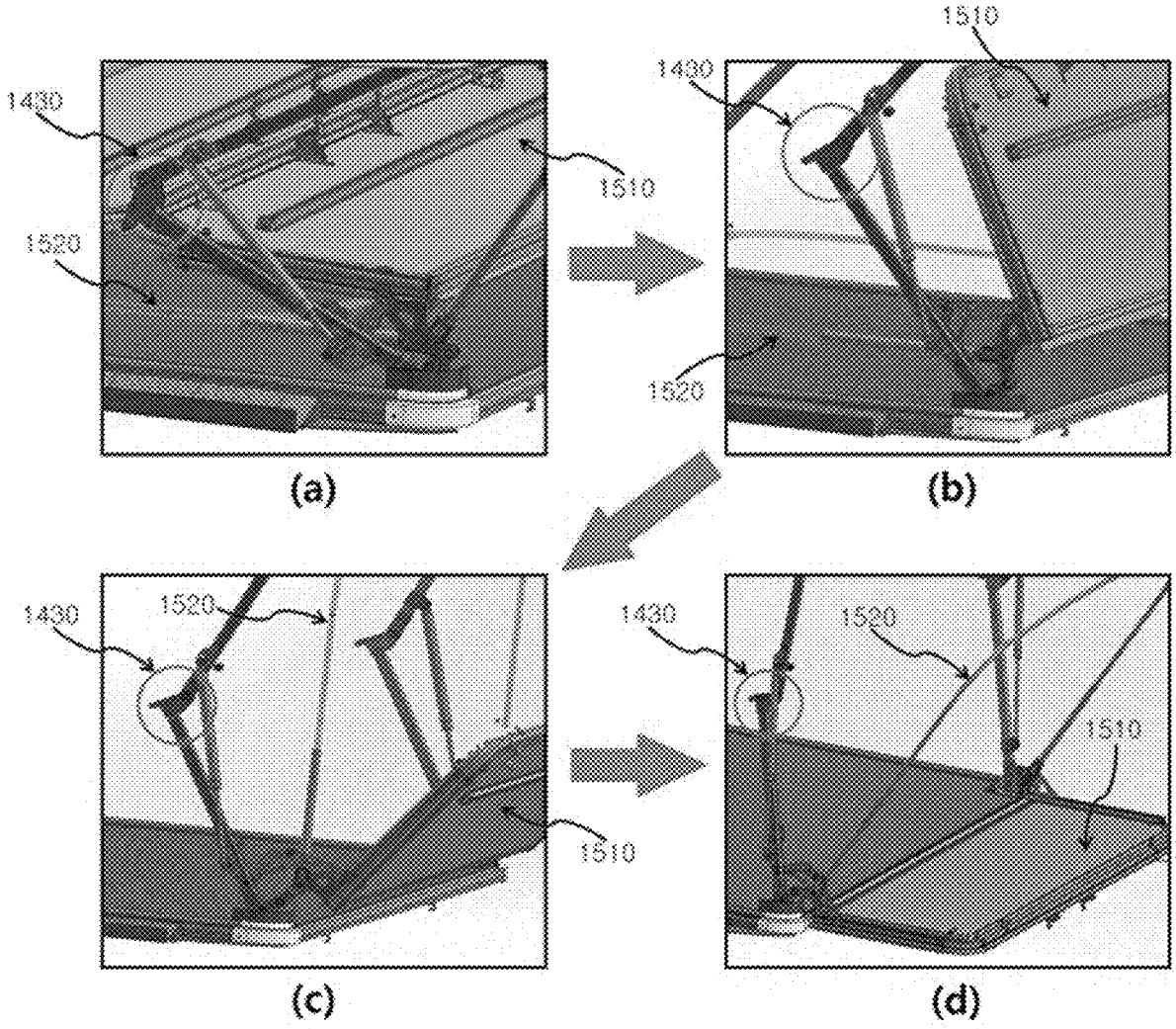
FIG. 8 illustrate each step of the process in which the extension plate 1510 and the pole 1520 are automatically folded, in an enlarged manner.

(a), (b), (c), and (d) of FIG. 8 illustrate each step of the process in which the extension plate 1510 and the pole 1520 are automatically folded in FIG. 7 in the process of opening the rooftop tent 1000 of one embodiment of the present disclosure, in an enlarged manner. Referring to (a), (b), (c), and (d) of FIG. 8, it can be seen that when the rooftop tent (1000) is unfolded, the extension plate 1510 and the pole 1520 are interlocked and automatically unfolded by the link structure 1400. The extension plate 1510 and the pole 1520 are connected to the link structure 1400, and the link structure 1400 is connected to the link 1410. Accordingly, it can be seen that when the link 1410 moves upward, the extension plate 1510 and the pole 1520 connected in conjunction with the link 1410 are naturally unfolded.

Figure 9:
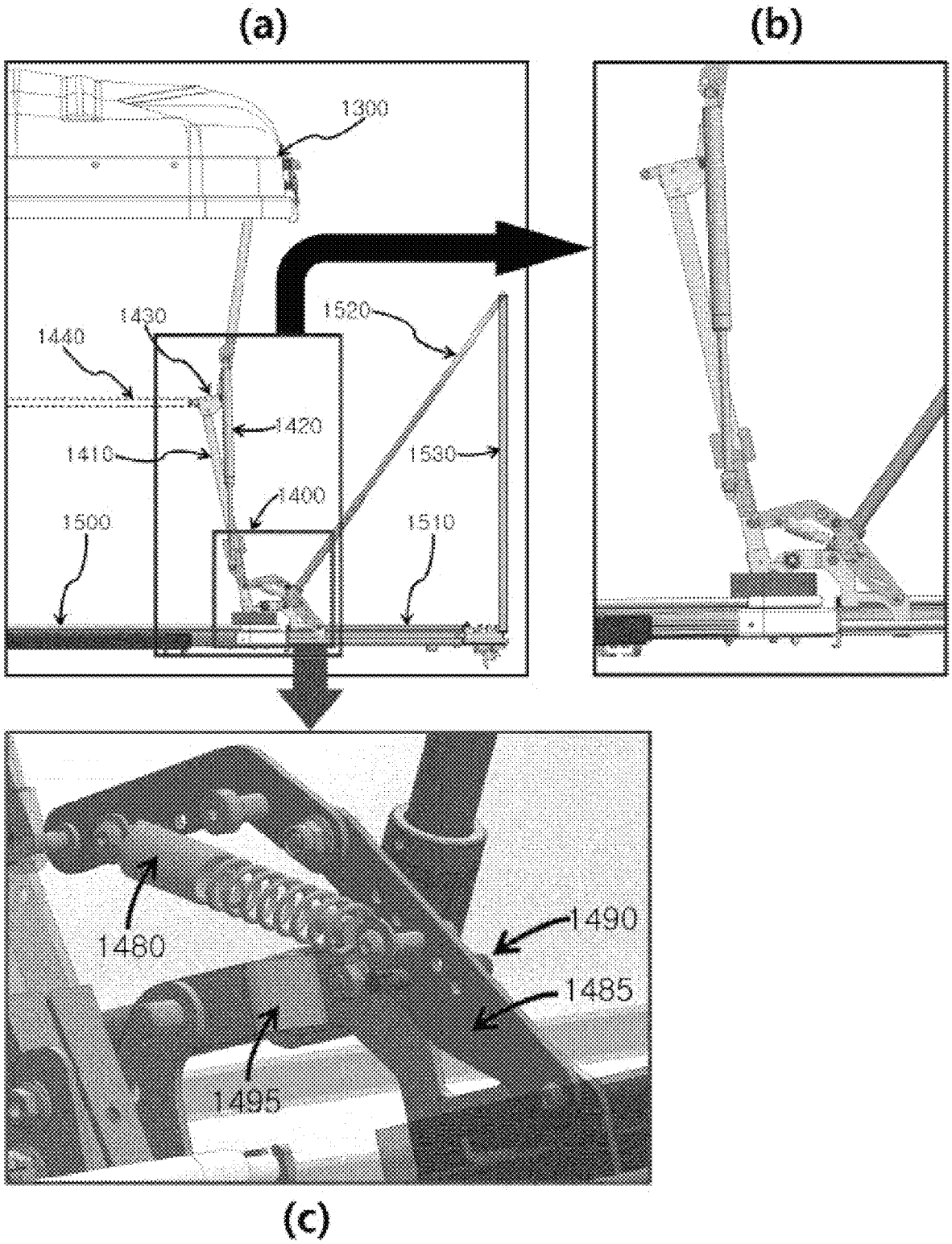
FIG. 9 illustrates a state where the extension plate 1510 and the pole 1520 are unfolded in the open state of the rooftop tent 1000 of the present disclosure, a state where the webbing strap 1530 fixes the pole 1520 to the end portion of the extension plate 1510, and a separate view of the link structure 1400, and a part of the link structure 1400.

(a) of FIG. 9 illustrates a state where the extension plate 1510 and the pole 1520 are unfolded in the open state of the rooftop tent 1000 according to one embodiment of the present disclosure and a state where the webbing strap 1530 fixes the pole 1520 to the end portion of the extension plate 1510. The webbing strap 1530 serves to stably fix the pole 1520 to the end portion of the extension plate 1510. The pole 1520 has both ends connected to the link structure 1400, stored in the upper end of the lower case 1500 when the tent 1200 is closed, and when the tent 1200 is opened. Moreover, when the tent 1200 is opened, the pole 1520 maintains a predetermined angle with the extension plate 1510 while being unfolded in conjunction with the extension plate 1510 to expand an indoor space of the tent 1200 and maintain tension of the tent 1200.

(b) of FIG. 9 is an enlarged view of only the link structure 1400. The link structure 1400 is disposed at each corner of the upper case 1300 and the lower case 1500 in the rooftop tent 1000 according to one embodiment of the present disclosure, and includes an upper end link and a lower end link connected by the hinge 1430, the link 1410 configured to open and close the tent 1200 with one touch, the shock absorber 1420 that controls the opening and closing of the link, an upper connector 1485 and a lower connector 1495 configured to automatically unfold and fold the extension plate 1510 in conjunction with a one-touch opening and closing of the tent 1200, and a connector spring 1480 that pulls the extension plate 1510 into the lower case 1500 when the extension plate 1510 is folded.

In addition, as illustrated in (c) of FIG. 9, the link structure 1400 further includes a connector fixing pin 1490 that fixes the upper connector 1485 and the lower connector 1495 so that the opening state of the tent 1200 is maintained and stability in setting of the tent is secured.

Figure 10:
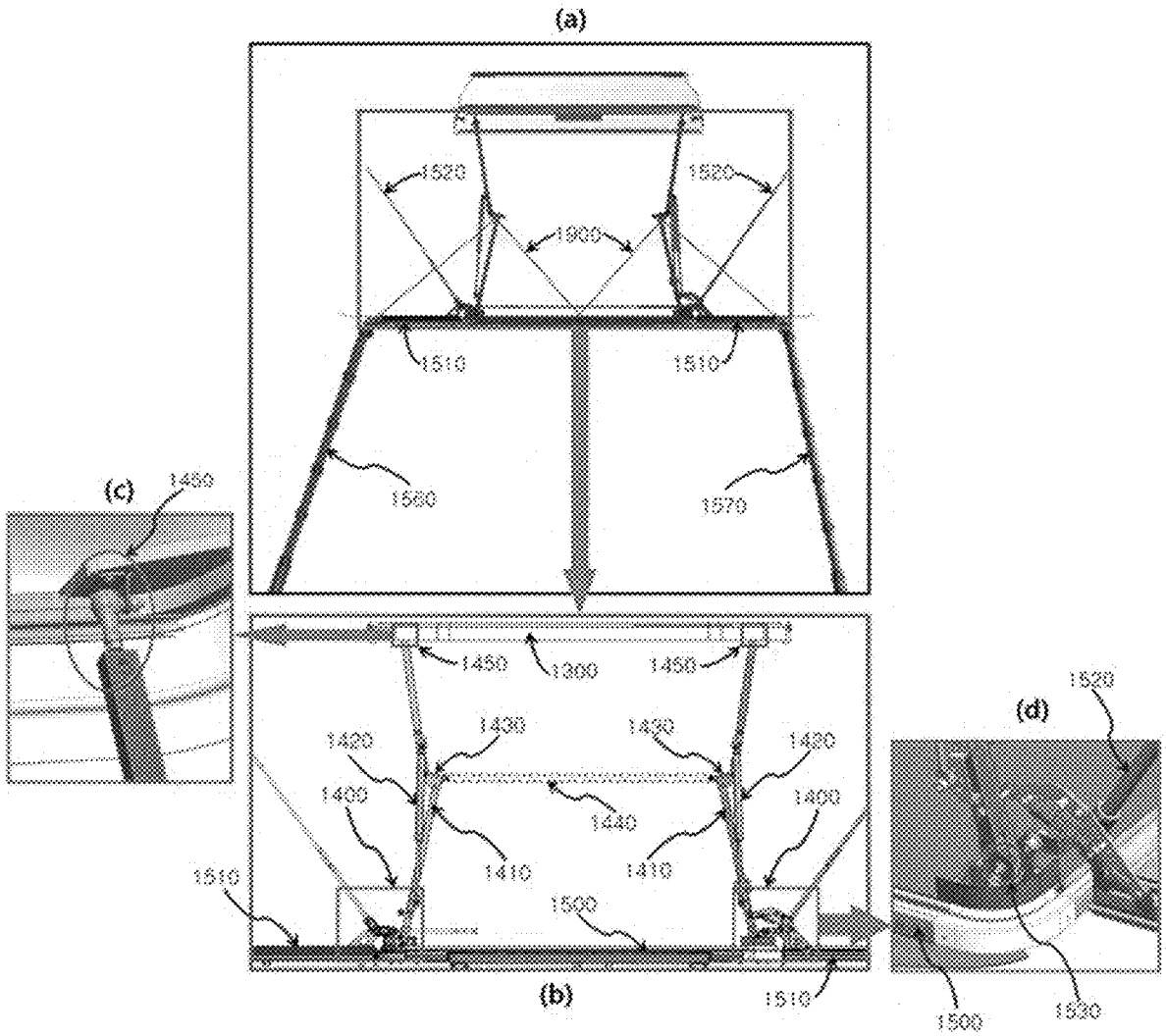
FIG. 10 illustrates the rooftop tent 1000 of the present disclosure in an open state, a hinge fixing device 1440 installed on a pair of hinges 1430, an enlarged view of a spherical joint 1450 coupling an upper case 1300 and a link 1410, and an enlarged view of a part of the link structure 1400 coupling a lower case 1500 and the link 1410.

(a) of FIG. 10 illustrates that the link structure 1400 may further include at least a pair of high-strength wires 1900 to support the extension plates 1510 connected to both sides of the lower case 1500 in a state where the tent 1200 is open. In addition, from (a) of FIG. 10, the link 1410 is configured so that two pillars are connected up and down about the hinge 1430 to perform the opening and closing operations of the link, and it can be seen that the shock absorber 1420 is responsible for stably performing the opening and closing operations of the link 1410.

(b) of FIG. 10 illustrates a state in which the hinge fixing device 1440 is coupled to the pair of hinges 1430, and in one embodiment of the present disclosure, in order to fix the rooftop tent 1000 in the open state, as illustrated in (b) of FIG. 10, a hinge fixing device 1440 is coupled to the pair of hinges 1430, or as illustrated in (c) of FIG. 9, the opening state of the tent 1200 can be maintained by the connector fixing pin 1490 fixing the upper connector 1485 and the lower connector 1495 of the link structure 1400 so as not to move.

(c) of FIG. 10 illustrates an enlarged state of a spherical joint 1450 connecting the upper case 1300 and the link 1410, and from (c) of FIG. 10, the spherical joint 1450 may be a double joint or a one-sided bolt joint having three axial degrees of freedom with a shaft hole, and the spherical joint 1450 may increase the degree of freedom of the hinge 1430 to prevent deformation of the link 1410 caused by twisting of the link 1410 when the upper case 1300 is sequentially opened or closed back and forth.

(d) of FIG. 10 illustrates a partially enlarged state of the link structure 1400 coupling the lower case 1500 and the link 1410.

Figure 11:
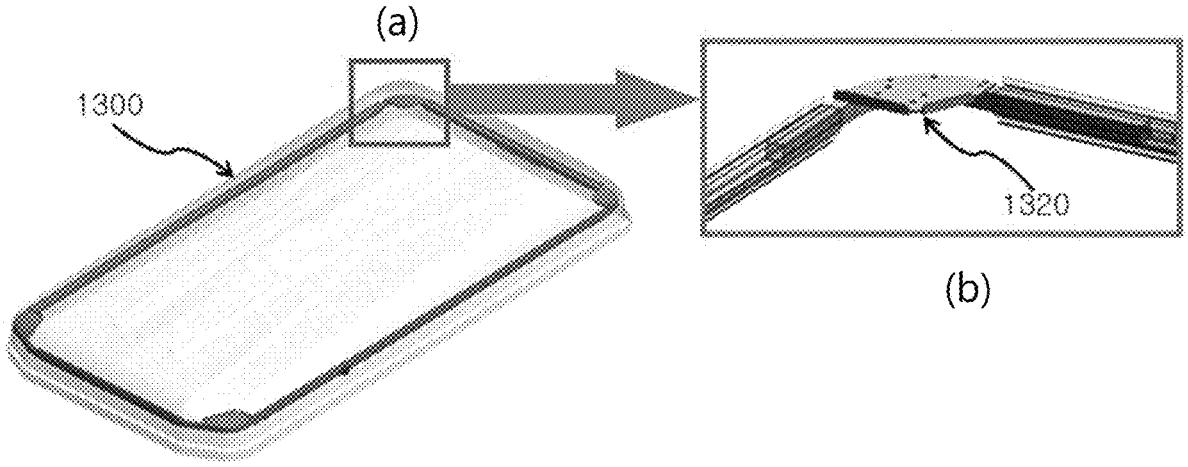
FIG. 11 illustrates the upper case 1300 of the present disclosure including an extrusion structure rivet 1320 and a hard-shell cover made of a lightweight and robust aluminum material, and an enlarged view of the extrusion structure rivet 1320.

(a) of FIG. 11 illustrates, for example, an upper case 1300 including an extrusion structure rivet 1320 formed of a lightweight aluminum material, and (b) of FIG. 11 illustrates an enlarged view of the extrusion structure rivet 1320. In one embodiment of the present disclosure, since the rooftop tent 1000 should be light and strong, for this purpose, the upper case 1300 adopts a hard-shell cover, and the corner adopts an extruded structure rivet 1320 to prevent deformation of the upper case 1300 and secure robustness.

Figure 12:
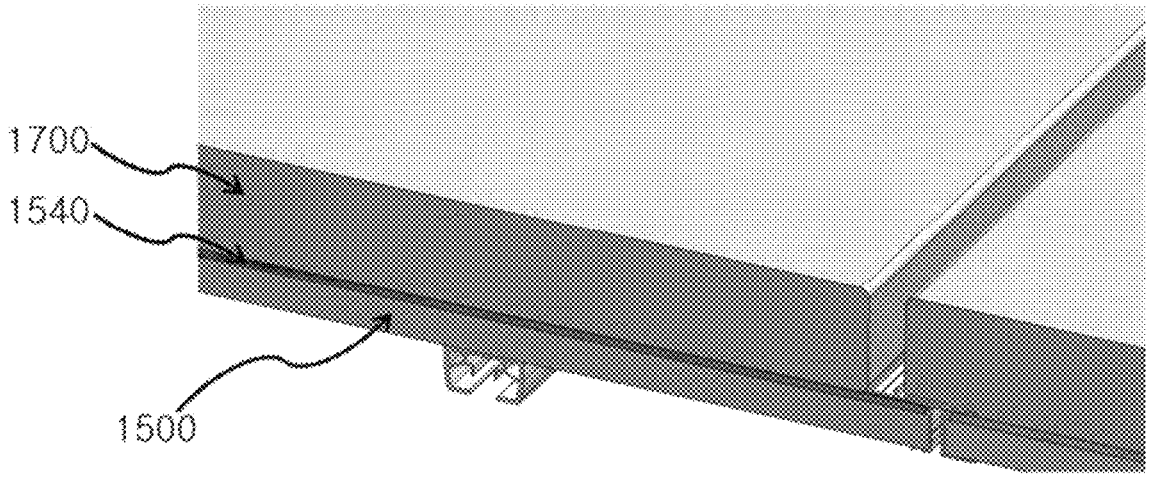
FIG. 12 illustrates a state where a heat insulating layer 1540 is added to the top of the lower case 1500 of the present disclosure including a lightweight and robust honeycomb structure so as to prevent condensation in the tent 1200, for example, a state where wood is added and a cushion 1700 is installed on the wood.

In FIG. 12, in one embodiment of the present disclosure, since the rooftop tent 1000 should be light and strong, for this purpose, the lower case 1500 adopts a honeycomb structure and in order to prevent condensation in the tent 1200, a heat insulating layer 1540, for example, wood is added to the lower case 1500 and a cushion 1700 is installed on the wood. The heat insulating layer 1540 blocks heat transfer within the tent 1200 to the lower case 1500 having very high thermal conductivity, thereby preventing condensation within the tent 1200.

Figure 13:
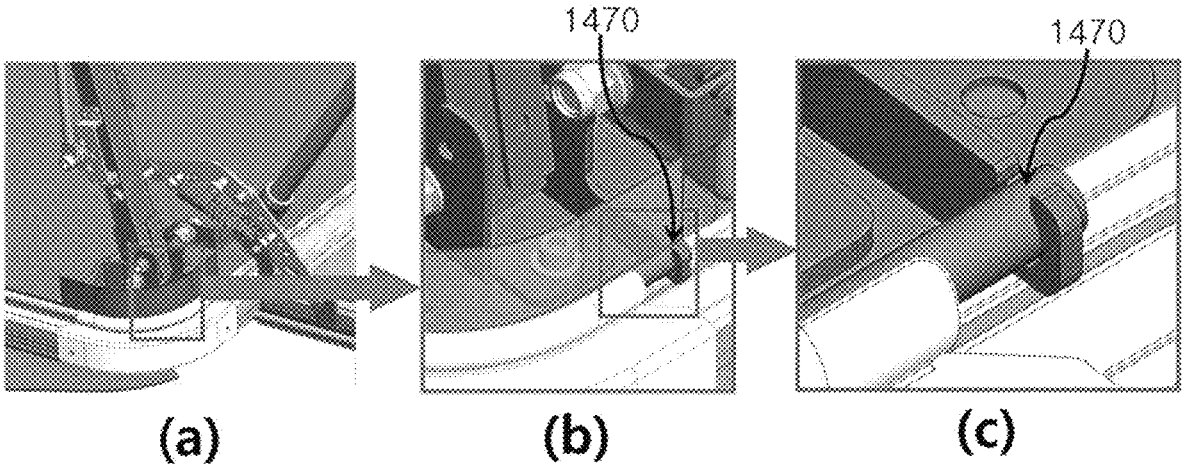
FIG. 13 illustrates a part of the link structure 1400 installed at a corner of the lower case, enlarged views, a predetermined groove 1470 in a part of the link structure.

(a) of FIG. 13 illustrates a part of the link structure 1400 installed at the corner of the lower case, (b) of FIG. 13 illustrates a predetermined groove 1310 for fixing the lower end of the tent 1200 in (a) of FIG. 13, and (c) of FIG. 13 is a further enlarged view of the predetermined groove 1310 in (b) of FIG. 13. In the rooftop tent 1000 according to one embodiment of the present disclosure, when connecting the lower end of the tent 1200 to the lower case 1500, the breakage of the tent stick occurs due to the upper connector 1485 and the lower connector 1495 connecting the extension plate 1500. The predetermined groove 1320 installed in a part of the link structure 1400 serves to fix the lower end of the tent 1200 to the lower case 1500 even when the stick of the tent 1200 is broken. Accordingly, it is possible to solve the problem that the tent lower end is not fixed to the lower case 1500 due to the breakage of the stick of the tent 1200.

Figure 14:
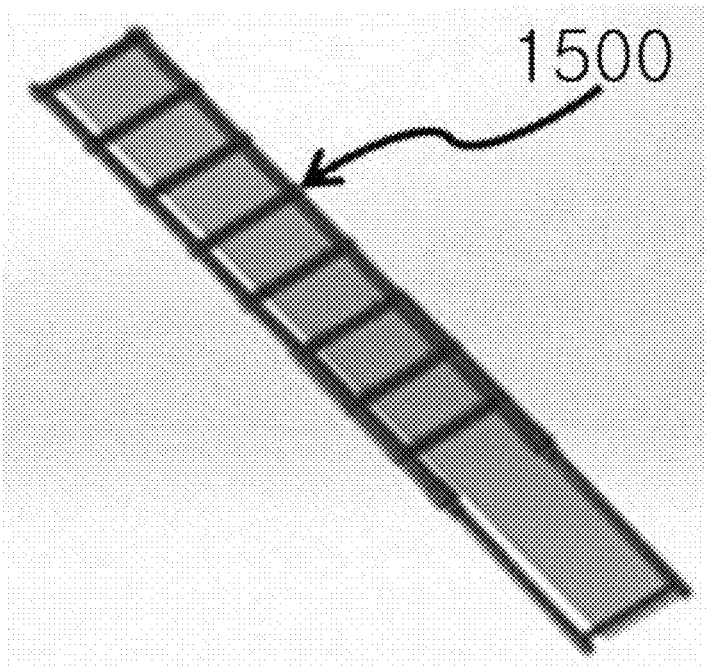
FIG. 14 illustrates a ladder supporting the extension plate when using the tent of the present disclosure.

FIG. 14 illustrates the ladder 1560 supporting the extension plate when the rooftop tent 1000 according to one embodiment of the present disclosure is opened. This ladder 1560 supports the extension plate 1510 for the safety of the rooftop tent 1000 and is used when the user or a pet climbs the tent. The ladder 1560 is coupled to the extension plate 1510 by a ladder connection portion 1550. On the other side of the ladder 1560, a support 1570 supports the opposite extension plate 1510. When not in use, the ladder 1560 can be folded and stored on the back of the extension plate 1510. In one embodiment of the present disclosure, the ladder 1560 has a structure in which an extendable leg is separately provided at the lower end portion so that people can use the ladder 1560 in normal situations and protrudes outward from the inside in normal situations, and a separate fabric is easily attached and detached to the ladder, and thus, even pets, not people, can climb into the tent.

Figure 15:
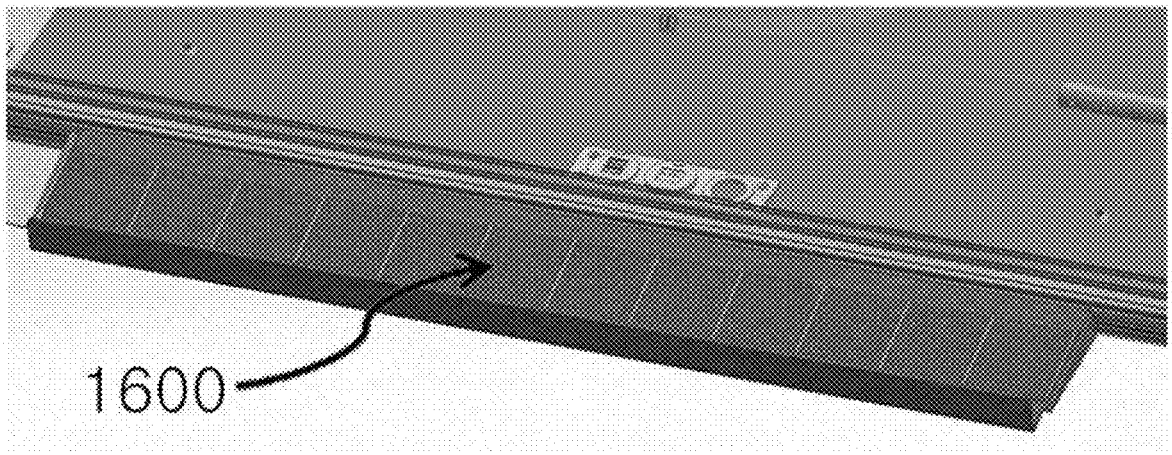
FIG. 15 illustrates a solar cell that produces electricity to be used when using the tent of the present disclosure.

FIG. 15 illustrates a solar cell 1600 generating electricity to be used when using the rooftop tent 1000 according to one embodiment of the present disclosure. The solar cell 1600 is installed on the side surface of the bottom plate of the lower case 1500, and when the tent 1200 is opened, light is supplied to the solar cell 1600 to generate power, and mobile phones can be charged in the tent during use of the tent 1200.

A method of opening (installing) and closing (folding) the rooftop tent 1000 according to one embodiment of the present disclosure is as follows.

1. Locking devices (not illustrated) are released and the upper case 1300 is lightly lifted upward in any direction.
2. In a state where the tent 1200 is fully open, the hinge fixing device 1440 is attached to the hinge 1430 of the link structure 1400 to prevent the tent (1200) from being accidentally closed, the ladder 1560 is installed in the entrance direction, and the support 1570 is installed on the other side. In addition, in order to maintain the stable open state of the tent 1200, the upper connector 1485 and the lower connector 1495 are fixedly coupled with the connector fixing pin 1490 so that the state of the link structure 1400 cannot be changed any longer, and thus, it is possible to prevent accidental closing of the tent 1200.
3. When the tent is closed after use, the hinge fixing device 1440, the connector fixing pin 1490, the ladder 1560, and the support 1570 are removed, and then, the closing webbing strap 1800 is pulled to close the tent 1200.
4. After the tent is completely closed, the surrounding locking devices are locked to prevent the tent 1200 from being opened.

Figure 16:
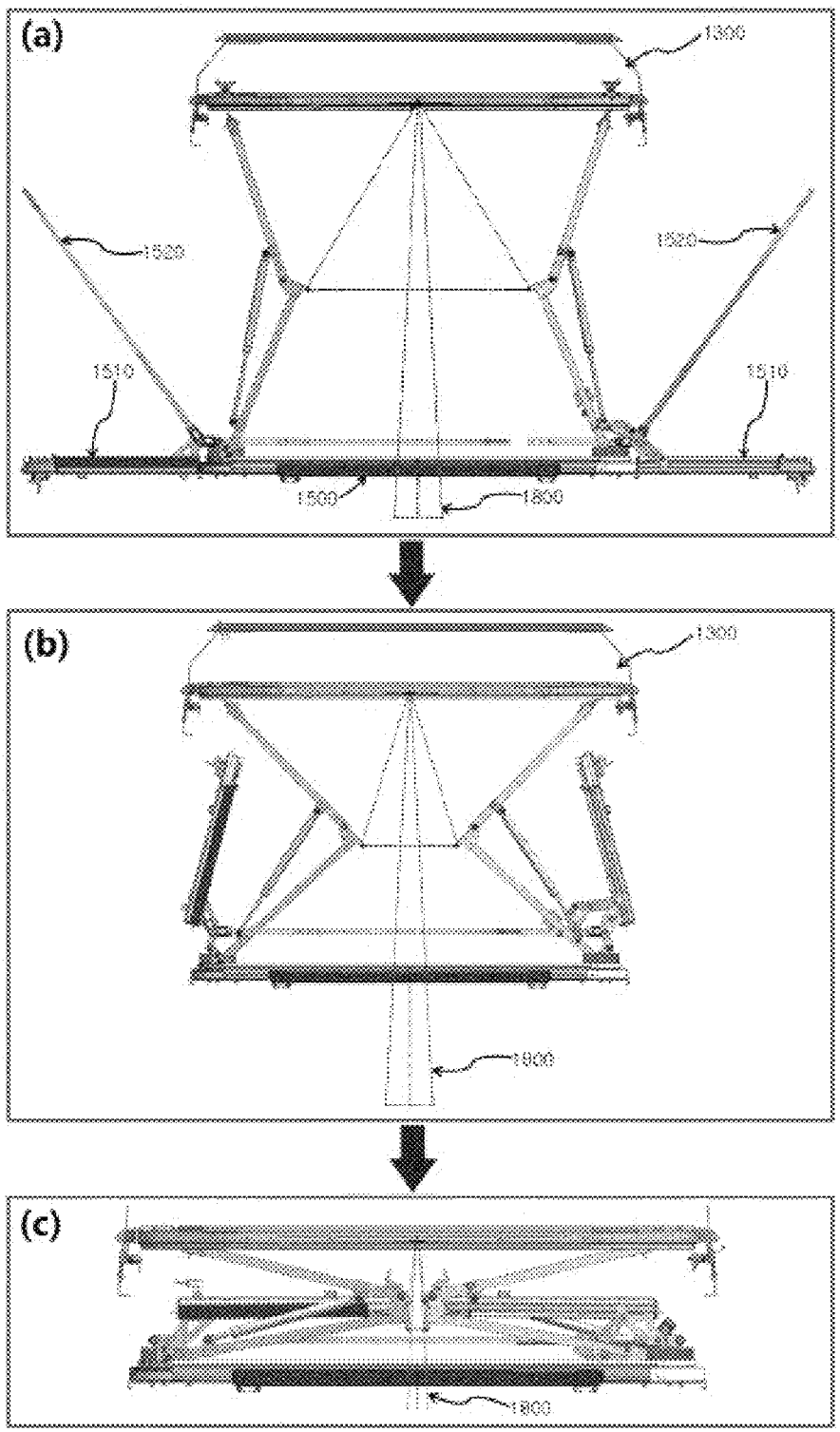
FIG. 16 illustrate steps of a one-touch closing process by a closing webbing strap 1800 when the rooftop tent 1000 is not used.

(a), (b), and (c) of FIG. 16 illustrate steps of a one-touch closing process by a closing webbing strap 1800 when the rooftop tent 1000 is not used.

The above description is an example in the present disclosure, and may be modified in various forms within a range not departing from the spirit of the present disclosure.

In the above, the present disclosure has been described in detail with reference to specific embodiments, but since the embodiments are only for exemplifying the present disclosure, substitutions, additions, and modified embodiments within the scope of the technical idea of the present disclosure should also be regarded as belonging to the protection scope of the present disclosure, which is defined by the appended claims below.

The invention claimed is:

1. A vehicle rooftop tent (1000) comprising:

a tent (1200);

an upper case (1300);

a link structure (1400);

a lower case (1500); and an extension plate (1510), wherein the tent (1200) has an upper end connected to a periphery of the upper case (1300) and a lower end connected to a periphery of a lower case (1500) and a periphery of the extension plate (1510) so that opening and closing are performed with one touch, the upper case (1300) includes a hard-shell cover to minimize deformation, improve strength, and implement a lightweight structure, and includes a corner portion and a straight section fastened by an extrusion structure rivet (1320), the link structure (1400) is disposed at each corner of the lower case (1500) so that the tent (1200) is opened and closed with one touch, and is configured so that the extension plate (1510) is automatically unfolded and folded in conjunction with the opening and closing of the tent (1200), the lower case (1500) has a honeycomb structure to improve strength and implement a lightweight structure, and the extension plate (1510) is configured to be automatically unfolded and extended to both sides of the lower case (1500) to expand a floor area when the tent (1200) is open, and is configured to be automatically folded to be stored in an upper portion of the lower case (1500) to reduce the floor area when the tent (1200) is closed, wherein each link structure (1400) includes a link (1410), a shock absorber (1420), and a hinge (1430) configured to open and close the tent (1200) with one touch, an upper connector (1485) and a lower connector (1495) configured to automatically unfold and fold the extension plate (1510) in conjunction with the opening and closing of the tent (1200) with one touch, and a connector spring (1480) for pulling the extension plate (1510) into the lower case (1500) when the extension plate (1510) is folded.

2. The vehicle rooftop tent of claim 1, wherein each link structure (1400) further includes a connector fixing pin (1490) that fixes the upper connector (1485) and the lower connector (1495) so that the opening state of the tent (1200) is maintained and stability in setting of the tent is secured.

3. The vehicle rooftop tent of claim 1, wherein each link structure (1400) further includes at least one pair of high-strength wires (1900) configured to support the extension plates (1510) connected to both sides of the lower case (1500) in a state where the tent (1200) is open.

4. The vehicle rooftop tent of claim 1, further comprising a pole (1520), wherein both ends of the pole (1520) are connected to the link structure (1400) and stored in the upper end of the lower case 1500 when the tent 1200 is closed, and when the tent (1200) is opened, the pole 1520 maintains a predetermined angle with the extension plate (1510) while being unfolded in conjunction with the extension plate (1510) to expand an indoor space of the tent (1200) and maintain tension of the tent (1200).

5. The vehicle rooftop tent of claim 1, further comprising a closing webbing strap (1800) for uniformly pulling the upper case (1300) downward so that the rooftop tent (1000) is closed by a one-touch operation when the rooftop tent (1000) is closed after use.

6. The vehicle rooftop tent of claim 1, wherein the hinge (1430) further includes a hinge fixing device (1440) for fixing the upper case (1300) so that the upper case (1330) does not move when the tent (1200) is opened, and even when the link (1410) is accidentally pushed by the hinge fixing device (1440) or the upper case (1300) is pressed, the opening state of the tent (1200) is maintained so that stability in setting of the tent is secured.

7. The vehicle rooftop tent of claim 1, wherein the upper case (1300) further includes a spherical joint (1450) having a shaft hole at a portion connecting the link (1410), and the spherical joint (1450) is a double joint or a one-sided bolt joint having three axial degrees of freedom, and the spherical joint (1450) increases the degree of freedom of the hinge (1430) to prevent deformation of the link (1410) caused by twisting of the link (1410) when the upper case (1300) is sequentially opened or closed back and forth.

8. The vehicle rooftop tent of claim 1, wherein the lower case (1500) has a double layer structure including a predetermined heat insulating layer (1540) on an upper portion of the lower case (1500) to prevent condensation inside the tent (1200) caused by a temperature difference between the inside and outside of the tent (1200).

9. The vehicle rooftop tent of claim 1, wherein the link structure (1400) further includes a predetermined groove (1470) configured to fix a lower end of the tent (1200) so that the lower end of the tent (1200) is fixed to the lower case (1500) even in a case where a tent stick is broken when the tent (1200) is installed.

10. The vehicle rooftop tent of claim 1, wherein the rooftop tent (1000) further includes a solar cell (1600) on a side surface of the lower case (1500) to generate power required when using the tent (1200).

* * * * *